US010602815B2

(12) United States Patent
Rohde

(10) Patent No.: US 10,602,815 B2
(45) Date of Patent: Mar. 31, 2020

(54) JEWELRY DEVICE AND ASSEMBLY

(71) Applicant: Courtney Rohde, New York, NY (US)

(72) Inventor: Courtney Rohde, New York, NY (US)

(73) Assignee: Courtney Skye LLC, New York, NY (US)

( * ) Notice: Subject to any disclaimer, the term of this patent is extended or adjusted under 35 U.S.C. 154(b) by 104 days.

(21) Appl. No.: 15/625,181

(22) Filed: Jun. 16, 2017

(65) Prior Publication Data

US 2018/0360174 A1 Dec. 20, 2018

(51) Int. Cl.

| | |
|---|---|
| ***A44C 25/00*** | (2006.01) |
| ***A44C 5/18*** | (2006.01) |
| ***A44C 15/00*** | (2006.01) |
| ***A44C 5/20*** | (2006.01) |

(52) U.S. Cl.

CPC ..... *A44C 25/004* (2013.01); *A44C 5/185* (2013.01); *A44C 5/20* (2013.01); *A44C 15/005* (2013.01); *A44C 15/0085* (2013.01)

(58) Field of Classification Search

CPC ..... A44C 5/185; A44C 15/005; A44C 25/004; A44C 15/0085; A44C 5/20; Y10T 24/3936; Y10T 24/3956

USPC ..... 63/1.14, 19, 21, 24

See application file for complete search history.

(56) References Cited

U.S. PATENT DOCUMENTS

| | | | | |
|---|---|---|---|---|
| D56,196 | S | 8/1920 | Schuler | |
| D59,240 | S | 10/1921 | Lieberfreund | |
| 1,578,940 | A | 3/1926 | Wacha | |
| 2,213,516 | A | 9/1940 | Beehan | |
| D140,450 | S | 2/1945 | Rubel | |
| D161,612 | S | 1/1951 | Carnevale | |
| 2,831,948 | A | 4/1958 | Fraser | |
| 4,023,712 | A | 5/1977 | Babiak et al. | |
| 4,420,076 | A | 12/1983 | Beveridge et al. | |
| D281,369 | S | 11/1985 | Harris | |
| D282,055 | S | 1/1986 | Brinkers | |
| 4,754,534 | A | 7/1988 | Helwick | |
| D308,951 | S | 7/1990 | Rinck | |
| 5,214,940 | A | 6/1993 | Capifali | |
| D347,297 | S | 5/1994 | Vesco | |
| 5,511,390 | A * | 4/1996 | Mah | A44C 25/00 206/37.1 |
| 5,687,585 | A | 11/1997 | Ferrell | |
| 5,722,260 | A | 3/1998 | Mangano | |
| 5,927,104 | A | 7/1999 | Green | |
| D433,225 | S | 11/2000 | Deiss et al. | |
| 6,152,751 | A | 11/2000 | Hanson et al. | |

(Continued)

OTHER PUBLICATIONS

Non-Final Office Action, U.S. Appl. No. 29/596,731, dated Nov. 21, 2019, 7 pages.

*Primary Examiner* — Abigail E Troy
(74) *Attorney, Agent, or Firm* — Merchant & Gould P.C.

(57) ABSTRACT

Jewelry devices and assemblies for adjusting the appearance of jewelry as worn. The assemblies include a clip having first and second shell pieces pivotally coupled together with a hinge disposed within an interior volume defined by the shell pieces. Gripping members defining gripping surfaces are affixed to interior surfaces of the shell pieces and cooperate to hold in place one or more portions of a necklace, bracelet, anklet, and the like. In some examples, a portion of an elongated member of a jewelry article, such as a necklace chain, is couplable to a terminal extending from one of the shell pieces.

18 Claims, 6 Drawing Sheets

(56) References Cited

U.S. PATENT DOCUMENTS

| | | | | |
|---|---|---|---|---|
| 6,422,036 | B1 | 7/2002 | Giannis et al. | |
| 6,460,231 | B2 * | 10/2002 | Bourgerie | A01K 97/08 24/487 |
| D575,664 | S | 8/2008 | Greer | |
| D583,700 | S | 12/2008 | Greer | |
| D606,447 | S | 12/2009 | West et al. | |
| D629,711 | S | 12/2010 | Gaspard | |
| D654,391 | S | 2/2012 | Minkkinen et al. | |
| 8,146,210 | B2 * | 4/2012 | Nishtala | A61M 5/1418 24/16 R |
| D675,953 | S | 2/2013 | Kapur et al. | |
| D734,196 | S | 7/2015 | Horvatinovich | |
| D761,150 | S | 7/2016 | Penna | |
| D777,599 | S | 1/2017 | Adler | |
| D811,261 | S | 2/2018 | Abdoo | |
| 2009/0301134 | A1 | 12/2009 | Kim-Araneo | |
| 2014/0120507 | A1 | 5/2014 | Horvatinovich et al. | |
| 2015/0101364 | A1 | 4/2015 | Snow et al. | |
| 2016/0166020 | A1 | 6/2016 | Lovett | |

* cited by examiner

JEWELRY DEVICE AND ASSEMBLY

BACKGROUND

Necklaces and other jewelry donned with a chain, strap, or string (e.g., a bracelet, an anklet, etc.) are desirable for their beauty and their appearance enhancing characteristics. They can be selected and worn for purely ornamental and/or sentimental reasons. These and other jewelry articles can also express subtle and complex messages that reflect the views, opinions, attitudes, culture, religion, or background of the wearer.

Typically, articles of jewelry are not readily modifiable by the end user. If an owner of an article of jewelry desires to alter the appearance of the jewelry when worn, e.g., it is often necessary for a jeweler to make those adjustments, and such adjustments are not readily reversible. For example, if the end user desires to make a necklace chain longer or shorter than its current length, typically a jeweler is commissioned to add or remove links from the chain.

There is a need for necklaces and other chained or strapped/stringed jewelry whose worn appearance is readily adjustable.

SUMMARY

In general terms the present disclosure is directed to adjustable jewelry devices and adjustable jewelry assemblies, and methods of arranging the jewelry devices and assemblies on a wearer.

According to certain aspects of the present disclosure, a jewelry device includes a clip having an open configuration and a closed configuration, the clip having first and second shell pieces that are pivotally coupled to each other to pivot between the open configuration and the closed configuration. In the closed configured two shell pieces define an interior volume of the clip in which at least one gripping member is disposed, the at least one gripping member adapted to abut and frictionally hold one or more jewelry chains in place when the clip is in the closed configuration.

In some examples, each of the shell pieces defines an interior cavity, the interior cavities together forming the interior volume of the clip when the clip is in the closed configuration.

In some examples, the clip includes a terminal extending from one or both of the shell pieces, the terminal adapted to receive a portion of a jewelry chain, strap, string, etc. Chains, straps, and strings are terms used herein as non-limiting examples of elongated elements known in the art used to attach jewelry such as necklaces, bracelets, and anklets, to the wearer.

In some examples, the shell pieces are made of one or more precious metals, precious metals, and/or gem stones. In some examples, the at least one gripping member is made of a resiliently compressible material capable of regaining its uncompressed form when a compression force is released.

In some examples, the at least one gripping member is made from one or more of natural rubber, an elastomer, Teflon®, silicone, vinyl, foam rubber, and so forth. In some examples, the first shell piece includes a first locking element that is complementary to a second locking element on the second shell piece, the first and second locking elements adapted to mate with each when the clip is in the closed configuration.

In some examples, the shell pieces are pivotally coupled together with a hinge. In some examples, the hinge is partially or completely disposed within one or both of the cavities, and, correspondingly, partially or completely disposed within the interior volume when the clip is in the closed configuration.

According to further aspects of the present disclosure a jewelry device includes a clip having an open configuration and a closed configuration, the clip having first and second shell pieces that are pivotally coupled to each other. In the closed configuration, the shell pieces substantially define a tube having an interior volume extending longitudinally between opposing ends of the tube. The shape defined by the shell pieces in the closed configuration need not be perfectly tubular. For example, the inner surface and/or the outer surface of one or both of the shell pieces can include one or more flattened portions, one or more portions of smaller or larger curvature radius, one or more engravings, and/or one or more embossments.

In some examples, each shell piece has an inner surface that defines a cavity and an outer surface that substantially defines a portion of a surface of a longitudinally divided cylinder. Radial end faces perpendicular to the longitudinal direction extend between the inner surface and the outer surface at opposing longitudinal extremes of each shell piece. In the closed configuration two shell pieces define the interior volume of the tube.

In some examples, a gripping member is disposed in, and substantially fills each cavity, the gripping members having substantially planar surfaces adapted to abut each other or nearly abut each other when the clip is in the closed configuration, such that the gripping members substantially fill the interior volume when the clip is in the closed configuration. By "nearly abut" is meant that in some examples there can be a gap between the opposing substantially planar surfaces of the gripping members when the clip is in the closed configuration such that the shortest distance between the opposing substantially planar sides of the gripping members is less than a thickness of a chain or strap/string to be held between the gripping members. Thus, for example, the shortest distance between the opposing substantially planar surfaces of the gripping members when the clip is in the closed configuration can be, e.g., less than about 3 mm, less than about 2 mm, less than about 1 mm, less than about 0.5 mm, less than about 0.2 mm, etc. Larger or smaller distances may also be suitable.

In some examples, the clip includes a terminal extending from one or both of the shell pieces, the terminal adapted to receive a portion of a jewelry chain or strap/string. The terminal can be, e.g., a ring or other holed feature to which, e.g, a chain link or strap/string of a necklace or other article of jewelry can be attached. In some examples, one of the shell pieces includes a terminal base from which the terminal extends, such as a crossbar disposed at one of the end faces of the shell pieces and extends perpendicularly to the longitudinal axis of the shell piece. In some examples, a chain or strap/string of an article of jewelry is attached to the terminal to form a jewelry assembly together with the clip.

In some examples, the inner wall of one or both shell pieces substantially defines a portion of a cylinder. In some examples, each of the gripping members is shaped substantially as a half cylinder that at least substantially fills one of the cavities.

In some examples, the shell pieces are made of one or more metals, precious metals, and/or gem stones.

In some examples, each gripping member is made of a resiliently compressible material capable of regaining its uncompressed form when compression force is released. In some examples, the gripping members are made from one or more of natural rubber, an elastomer, Teflon®, silicone, vinyl, foam rubber, and so forth.

In some examples, the first shell piece includes a first locking element that is complementary to a second locking element on the second shell piece, the first and second locking elements adapted to mate with each other when the clip is in the closed configuration.

In some examples, the first and second shell pieces are pivotally coupled together with a hinge and the hinge is partially or completely disposed within one or both of the cavities and, correspondingly, partially or completely disposed within the interior volume when the clip is in the closed configuration.

In some examples, one or more chains and/or straps/strings are frictionally held between the two gripping members, the clip being in a closed configuration to form a further jewelry assembly together with the clip. In some example assemblies, one or more of the chains/straps/strings are also attached to the terminal.

In some examples, jewelry assemblies of the present disclosure include two or more of any of the clips disclosed herein, and one or more jewelry chains/straps/strings frictionally held by the two or more clips.

According to further aspects of the present disclosure, a method includes securing a chain, strap or string of a jewelry article to a terminal of a clip, the clip having features according to the present disclosure; and forming a loop in the chain/strap/string of a selectable length by closing the clip on a selectable segment of the chain/strap/string such that the one or more gripping members of the clip hold the selected segment in place.

According to further aspects of the present disclosure, a method includes placing a plurality of necklaces around a wearer's neck; closing each of the plurality of necklaces to form a loop around the wearer's neck; grasping two noncontiguous segments of each of the plurality of necklaces behind the neck, the segments being selected such that the plurality of necklaces appears at a front of the wearer in a desired layered arrangement; feeding the pairs of noncontiguous segments into a clip in an open configuration, the clip having features according to the present disclosure; and closing the clip on each pair of noncontiguous segments such that the one or more gripping members of the clip hold the selected segment in place and maintain the desired layered arrangement.

According to yet further aspects of the present disclosure, a method comprises placing first and second necklaces around a wearer's neck and closing each of the first and second necklaces to form a loop around the neck; feeding the first necklace into two clips in an open configuration, each of the clips having features according to the present disclosure, the clips being positioned one on either side of the user's neck; closing a first of the clips on a first segment of the first necklace such that the one or more gripping members of the first clip hold the first segment of the first necklace in place; closing a second of the clips on a second segment of the first necklace such that the one or more gripping members of the second clip hold the second segment of the first necklace in place; closing the first of the clips on a first segment of the second necklace such that the one or more gripping members of the first clip hold the first segment of the second necklace in place; closing the second of the clips on a second segment of the second necklace such that the one or more gripping members of the second clip hold the second segment of the second necklace in place, wherein for each of the necklaces the first and second segments are not contiguous, and wherein the first and second segments of each of the necklaces are selected to provide for a desired layered arrangement of the necklaces.

A variety of additional aspects will be set forth in the description that follows. The aspects relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not necessarily to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
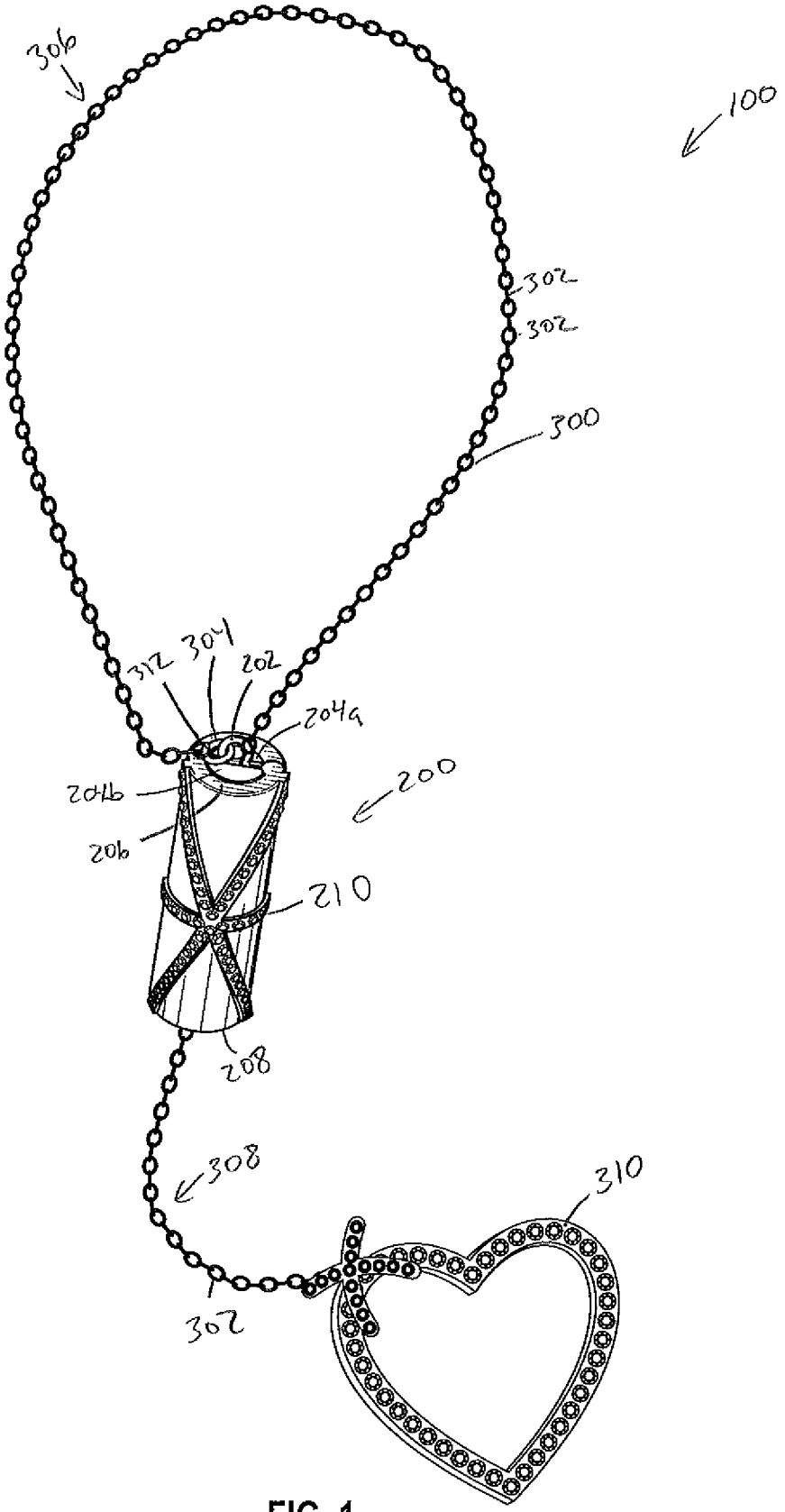
FIG. 1 is a perspective view an example jewelry assembly in accordance with the present disclosure.
Figure 2:
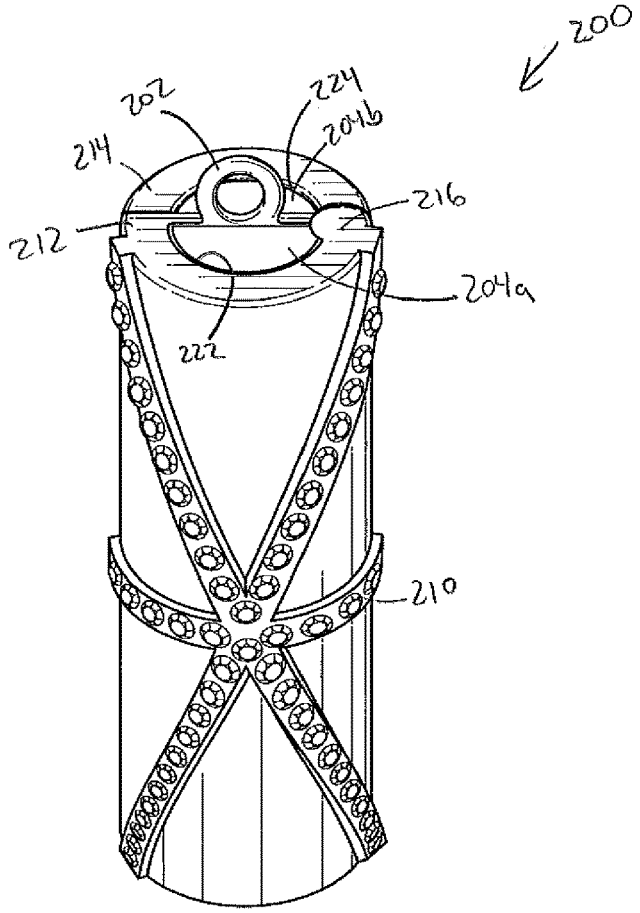
FIG. 2 is a perspective view of the example clip of the assembly of FIG. 1, the clip being in a closed configuration.
Figure 3:
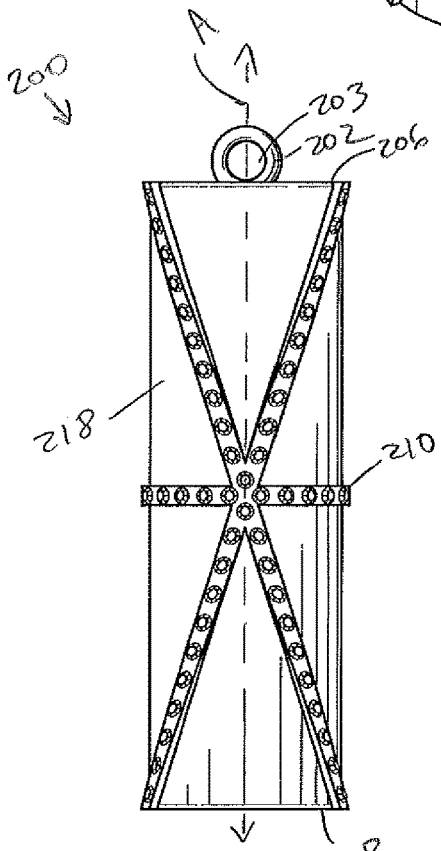
FIG. 3 is a side view of the example clip of the assembly of FIG. 1, the clip being in a closed configuration.
Figure 4:
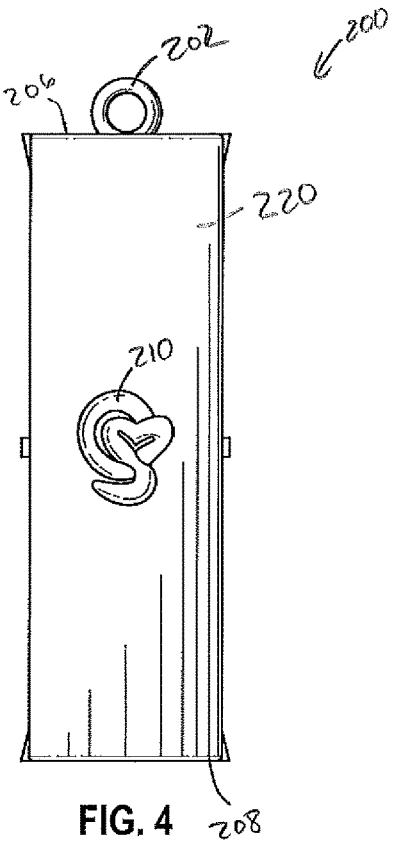
FIG. 4 is a further side view of the example clip of the assembly of FIG. 1, the clip being in a closed configuration.
Figure 5:
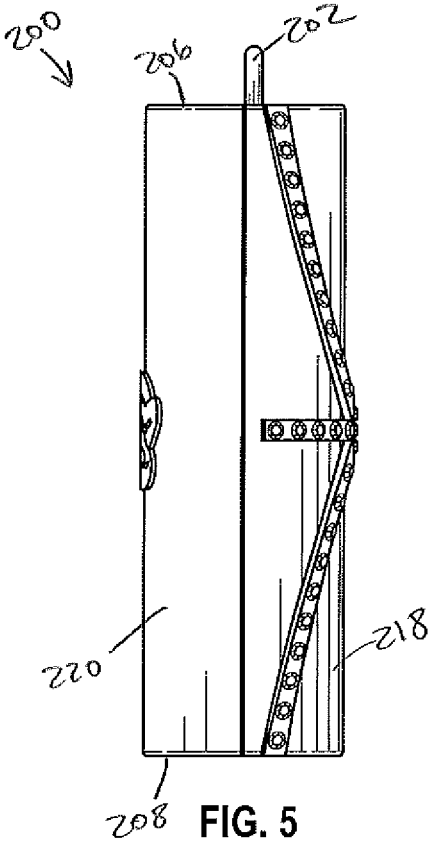
FIG. 5 is a further side view of the example clip of the assembly of FIG. 1, the clip being in a closed configuration.
Figure 6:
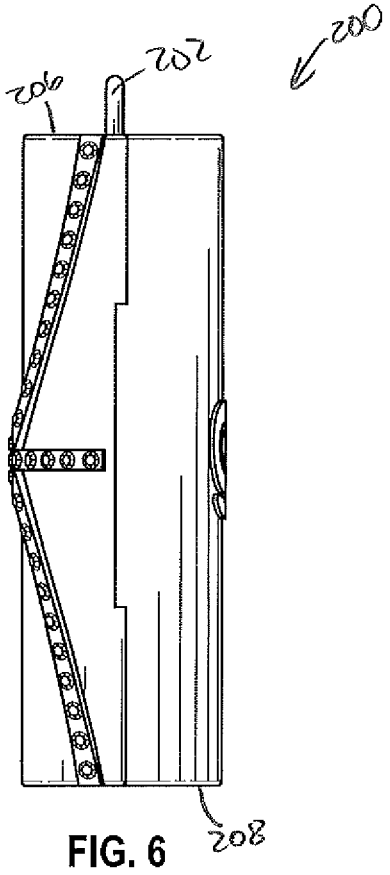
FIG. 6 is a further side view of the example clip of the assembly of FIG. 1, the clip being in a closed configuration.

Various embodiments are described herein in detail with reference to the drawings, wherein like reference numerals represent like parts and assemblies throughout the several views. Reference to various embodiments does not limit the scope of the appended claims. Additionally, any examples set forth in this specification are not intended to be limiting and merely set forth some of the many possible embodiments for the appended claims.

Figure 12:
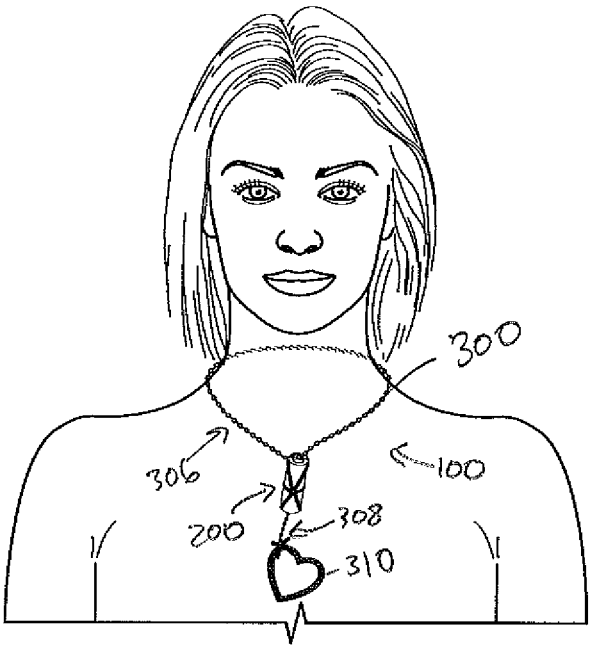
FIG. 12 is an example environmental view of the assembly of FIG. 1, the assembly being shown worn by a wearer.

Referring to FIG. 1, a jewelry assembly 100 is adapted to be worn by a user as shown, e.g., in FIG. 12.

The jewelry assembly 100 includes a clip 200 having terminal 202 and gripping members 204*a* and 204*b*. The assembly 100 further includes a chain 300. Although depicted as a chain 300 with chain links 302, it should be appreciated that other types of elongated elements known in the art to attach jewelry (e.g., a string, a strap, etc.) could substitute for the chain. A first end 312 of the chain 300 is attached to the terminal 202. A segment of the chain 300 that is noncontiguous with the end 312 is held between the two gripping members 204*a* and 204*b*, thereby providing for a loop 306 of the chain at one end 206 of the clip 200, and a tail 308 of the chain 300 extending from a second end 208 of the clip 200.

As shown in FIG. 12, the loop 306 can e.g., can be placed around the neck of the wearer. Thus, it should be appreciated that the selection of the segment of chain held between the two gripping members 204*a* and 204*b* can adjust the appearance of the assembly 100 when worn by the wearer.

Optionally, one or more adornments 310 (e.g., a charm, a pendant, etc.) can be attached to the second end of the chain 300, i.e., the end of the tail 308 that is farthest from the clip 200.

Optionally, one or more adornments 210 (e.g., an embossment, an engraving, a gemstone, etc.) can be provided on the clip 200.

Referring now to FIGS. 2-8, the clip 200 is shown in a closed configuration. Also referring to FIGS. 9-10, the clip 200 is shown in an open configuration. The clip 200 includes a first shell piece 212 and a second shell piece 214 that are pivotally coupled to each other with a hinge 216. In the closed configuration, the outer surfaces 218, 220 of the shell pieces 212, 214, together form the outer surface of the clip 200, the outer surface of the clip 200 being substantially cylindrical when the clip 200 is in the closed configuration.

Figure 7:
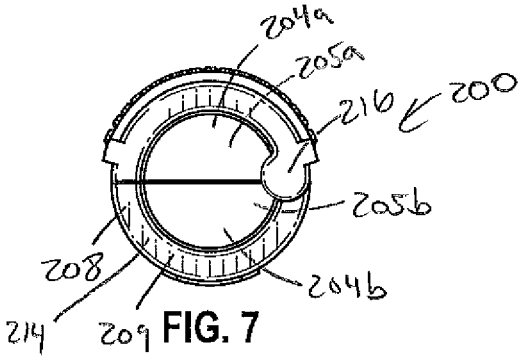
FIG. 7 is an end view of the example clip of the assembly of FIG. 1, the clip being in a closed configuration.
Figure 8:
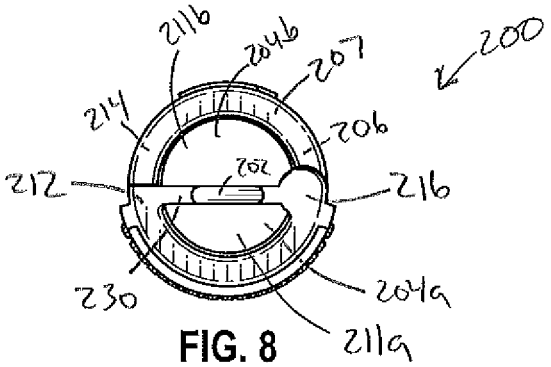
FIG. 8 is a further end view of the example clip of the assembly of FIG. 1, the clip being in a closed configuration

In the closed configuration the clip 200 is defined by a longitudinal axis A (FIG. 3), which passes through the center of the clip 200 into and out of the page in FIGS. 7-8.

The outer surfaces 218, 220 of the shell pieces 212 and 214, respectively, extend longitudinally between the first end 206 and the opposing second end 208.

The shell piece 212 extends radially inward (toward the longitudinal axis A) from the outer surface 218 to an inner surface 222. Similarly, the shell piece 214 extends radially inward from the outer surface 220 to an inner surface 224. At the ends 206 and 208, this radial extension defines end faces 207 and 209 of the clip 200, respectively, which are substantially planar and perpendicular to the longitudinal axis A.

Figure 9:
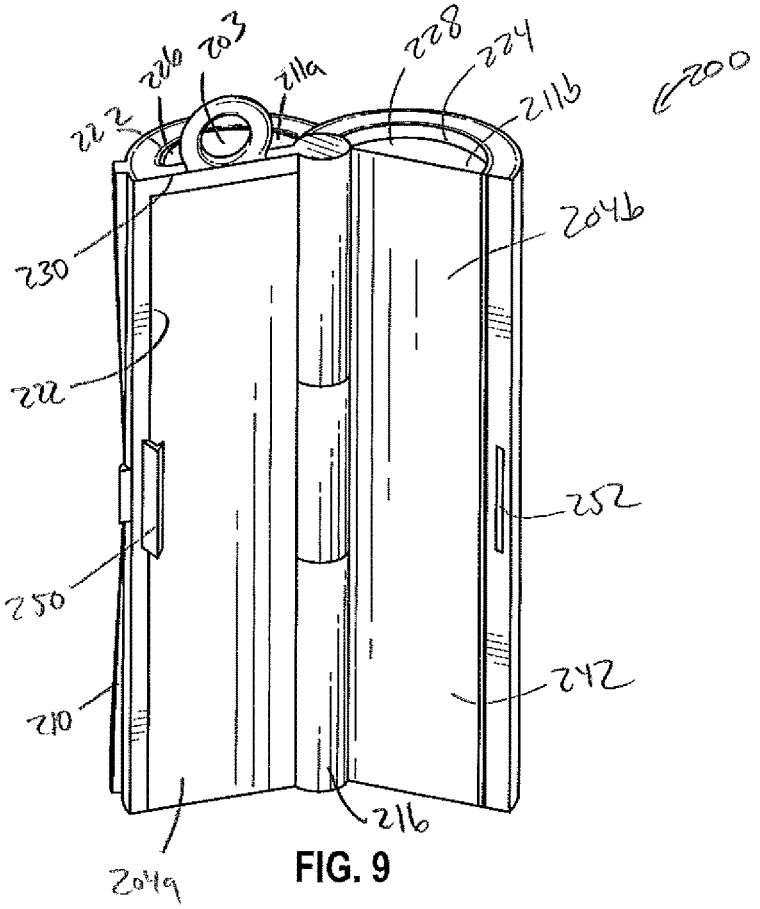
FIG. 9 is a perspective view of the example clip of the assembly of FIG. 1, the clip being in an open configuration.
Figure 10:
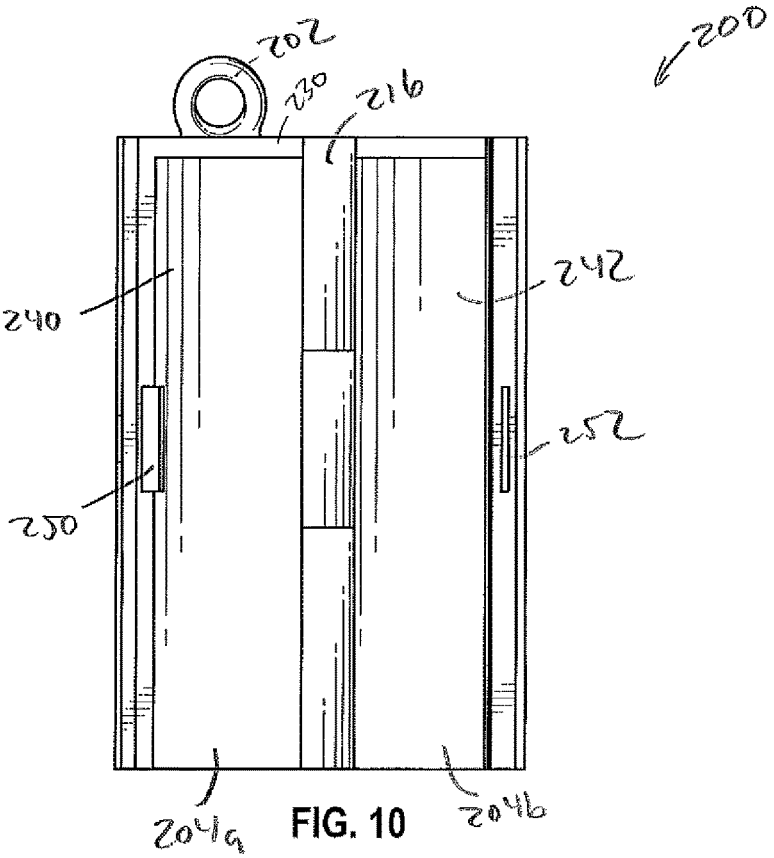
FIG. 10 is a side view of the example clip of the assembly of FIG. 1, the clip being in an open configuration.

In this example, each of the inner surfaces 222 and 224 forms part of a wall of a cylinder that extends between the first end 206 and the second end 208 of the clip 200. Due to the concave curvature (relative to the longitudinal axis A) of the inner surfaces 218, 220, each of the inner surfaces 218, 220 defines a cavity 226, 228, respectively (FIG. 9). In this example, each cavity extends the entire longitudinal length if its respective shell piece, i.e., from the first end 206 to the second end 208. When the clip 200 is in the closed configuration, the cavities 226 and 228 are adjacent and together form a substantially cylindrical interior volume of the clip 200. Thus, in the closed configuration, the shell pieces 212 and 214 together form a substantially tubular structure.

The hinge 216 is disposed within the interior volume of the clip 200.

In the example clip 200, a terminal base 230 supports the terminal 202. The terminal base 230 is a crossbar integrated with the first shell piece 212. The crossbar 230 extends perpendicularly to the longitudinal axis A between the inner surface 222 and the hinge 216, the crossbar 230 spanning the cavity 226 at the largest perpendicular distance between the inner surface 222 and the hinge 216. Alternatively, the terminal base and terminal can be integral with the second shell piece 214

It should be appreciated that the first shell piece, terminal, and terminal support can be a unitary structure, e.g., cast or machined as one piece and from the same material. Alternatively, these components can be manufactured separately and then assembled together, e.g., by soldering or welding. In this example, the terminal 202 is a ring having a hole 203, allowing, e.g., a clasp or a link of a necklace chain to couple to the ring. In addition, the terminal base can be any of a variety of suitable platforms suited to support the terminal.

The gripping member 204*a* substantially fills the cavity 226 and is therefore approximately half-cylindrical in shape, but sufficiently modified to accommodate the presence of the hinge 216, which abuts the gripping member 204*a* and juts into the cavity 226. The gripping member 204*a* thus has a substantially planar gripping surface 240 spanning the cavity 226 at the largest perpendicular distance between the inner surface 222 and the hinge 216, the substantially planar gripping surface 240 extending the longitudinal length of the gripping member 204*a*.

Similarly, the gripping member 204*b* substantially fills the cavity 228 and is therefore approximately half-cylindrical in shape, but sufficiently modified to accommodate the presence of the hinge 216, which abuts the gripping member 204*b* and juts into the cavity 228. The gripping member 204*b* thus has a substantially planar gripping surface 242 spanning the cavity 228 at the largest perpendicular distance between the inner surface 224 and the hinge 216, the substantially planar gripping surface 242 extending the longitudinal length of the gripping member 204*b*.

In some examples, the gripping members 204*a*, 204*b* are made of a resiliently compressible material capable of regaining its uncompressed form when compression force is released. Alternatively, the gripping members need not be resiliently compressible, but the gripping surfaces 240, 242 have one or more material characteristics or structural elements, such as grooves, ribs, nubs, or divots, that enable frictional holding of chains/straps/strings between the two gripping surfaces 240, 242 when the clip 200 is in the closed configuration. In some examples, the gripping members are made from one or more of natural rubber, an elastomer, Teflon®, silicone, vinyl, foam rubber, and so forth.

In the example clip 200 shown, surfaces 205*a*, 205*b*, 211*a*, 211*b* of the gripping members 204*a*, 204*b* are exposed to the exterior of the clip 200 when the clip 200 is in the closed configuration. Optionally, however, the end faces 207 and 209 can be extended to cover the surfaces 205*a*, 205*b*, 211*a* and 211*b* when the clip 200 is in the closed configuration.

In the closed configuration of the of the clip 200, in some examples, the gripping surfaces 240 and 242 abut each other and are sufficiently compressible to cooperate by sandwiching one or more chains/straps/strings therebetween without disturbing the substantially cylindrical nature of the clip 200. In other examples, there is gap between the gripping surface 240 and 242. In at least some of these examples, the gap is such that the shortest distance between the opposing substantially planar sides of the gripping members is less than a thickness of a chain or strap/string to be held between the gripping members. Whether or not there is a gap, the friction between the gripping surfaces 240, 242 and the chain/strap/string can help to prevent the chain/strap/string from moving about and, in the case of multiple chain/straps/strings held by the same clip 200, the friction between the gripping surface 240, 242 can help to prevent tangling of the chains/straps/strings in undesirable ways, thereby minimizing or preventing tarnishing or damage that may otherwise be caused by the chains/straps/strings' rubbing together.

The gripping members 204*a* and 204*b* can be affixed to the inner surfaces of their respective shell pieces (212, 214) through any suitable means, such as glue or other drying adhesive, hook and loop fasteners such as Velcro®, and so forth.

In some examples, the first shell piece includes a first locking element 250 that is complementary to a second locking element 252 on the second shell piece, the first and second locking elements adapted to mate with each other when the clip is in the closed configuration to reduce the chances of the clip 200 undesirably opening from the closed configuration. Non-limiting examples of possible locking mechanisms that can be used to achieve this functionality include, e.g., snaps, latches, pins, screws, clasps, etc. In the example shown, the locking element 250 is a male component (latch) disposed on a shell piece 212 opposite the hinge 216 and frictionally mates with a second locking element 252, which is a complementary female component (groove) disposed on the shell piece 214 opposite the hinge 216.

Figure 11:
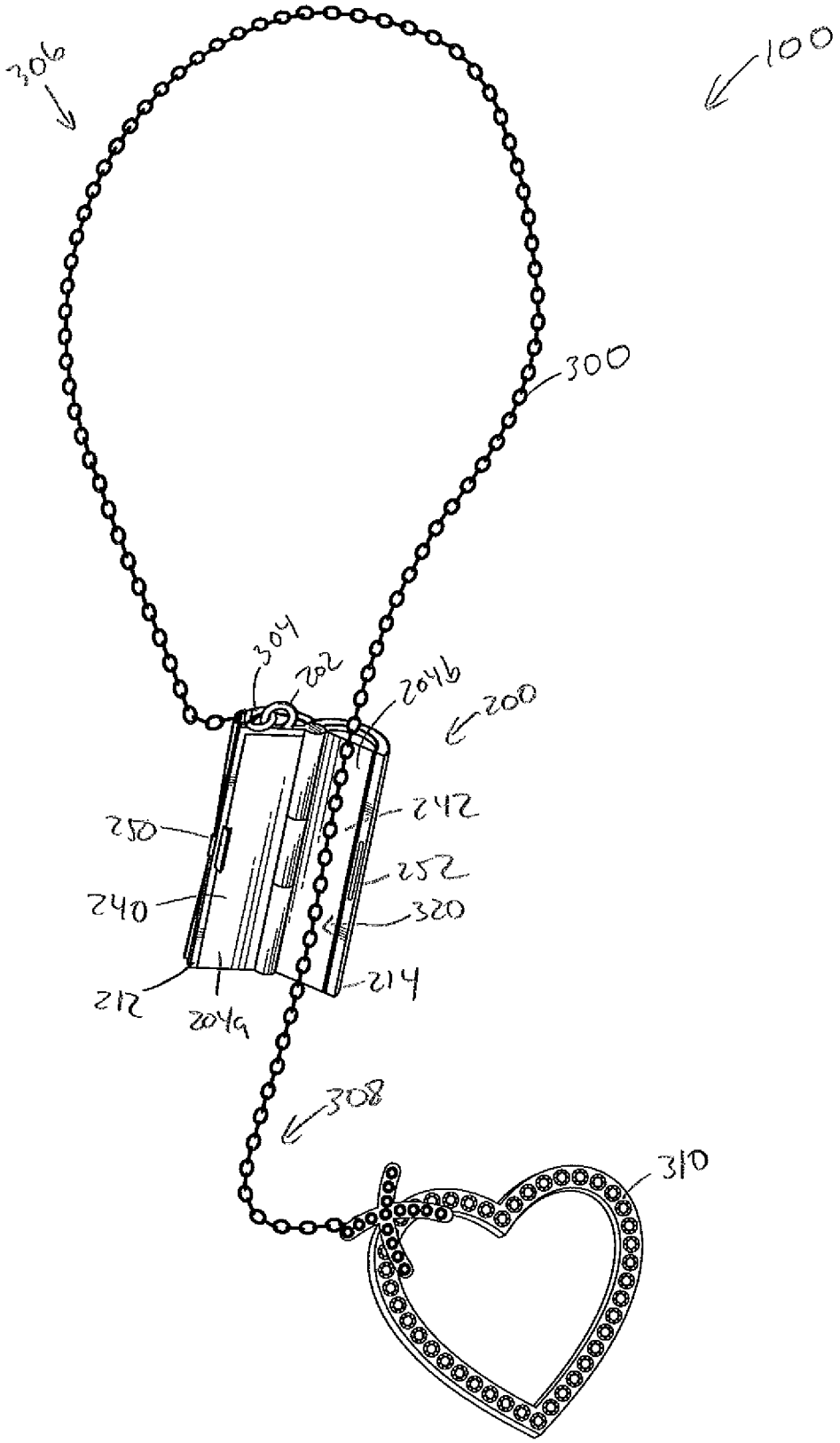
FIG. 11 is a side view of the assembly of FIG. 1, the clip being in an open configuration.

Referring now to FIG. 11, the assembly 100 is shown with the clip 200 in the open configuration. The clasp 304 at one end of the chain is coupled to the terminal 202. A segment 320 of the chain 300 abuts and extends substantially longitudinally along the gripping surface 242 of the gripping member 204*b*. When the clip 200 is closed, the segment 320 is held in place between the gripping surface 240 and 242. It should be appreciated that the lengths of the loop 306 and the tail 308 of the chain 300 can be adjusted based on the selected segment of the chain to be held between the gripping members 204*a* and 204*b*. FIG. 12 depicts how the assembly 100 might be worn on a wearer.

Figure 13:
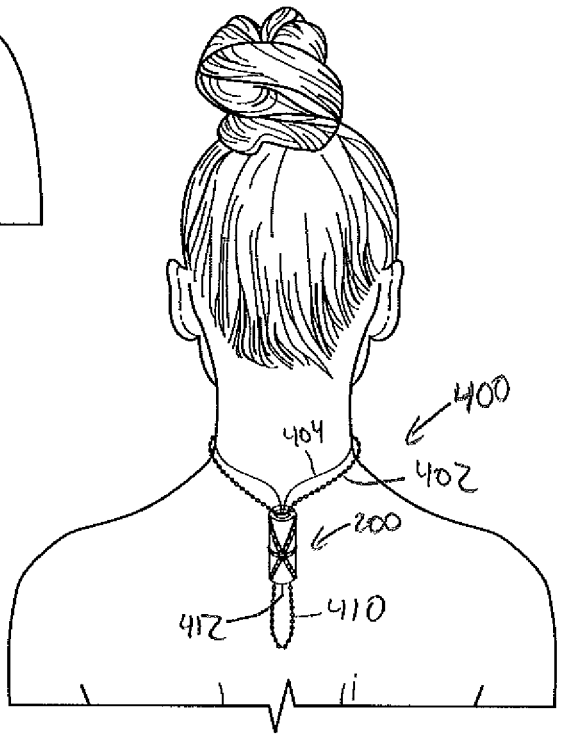
FIG. 13 is an example environmental view of a further example jewelry assembly in accordance with the present disclosure, the assembly being shown worn by a wearer.

Referring now to FIG. 13, a further jewelry assembly 400 is depicted as it might be worn by a wearer. The assembly 400 includes one of the clips 200, a first necklace 402 and a second necklace 404. Neither necklace is coupled to the terminal of the clip 200, though it should be appreciated that the assembly 400 could optionally include a necklace that is coupled to the terminal of the clip 200. Two selected segments of each of the necklaces 402 and 404 are held between the gripping surfaces of the gripping members of the clip 200. The specific segments chosen to be held in the clip 200 dictate the size of the loops 406 and 408 of the necklaces 402 and 404, as well is the length of slack 410 and 412, respectively, of the necklaces 402 and 404. Thus, a desired layered arrangement of the necklaces 402 and 404 is achievable, regards of the necklaces' relative lengths.

It should be appreciated that the clip 200 and its features can be adjusted in size to accommodate more necklaces, thicker necklaces, etc.

Figure 14:
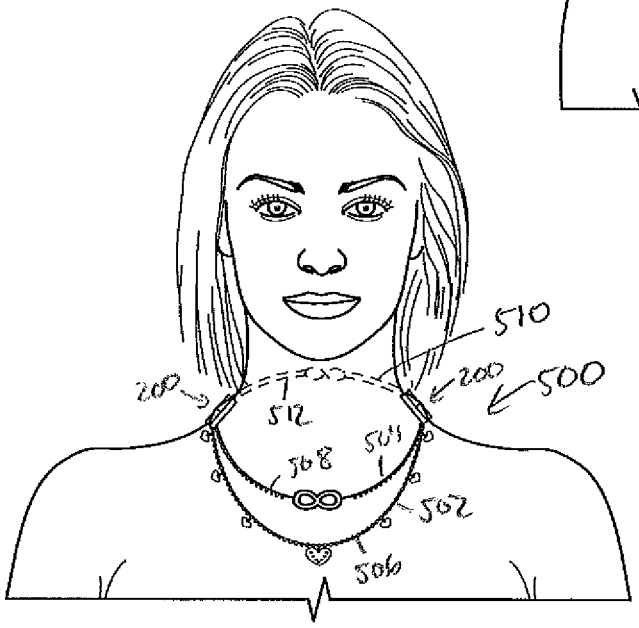
FIG. 14 is an example environmental view of yet a further example jewelry assembly in accordance with the present disclosure, the assembly being shown worn by a wearer.

Referring now to FIG. 14, a further jewelry assembly 500 is depicted as it might be worn by a wearer. The assembly 500 includes two of the clips 200, a first necklace 502 and a second necklace 504. Neither necklace is coupled to the terminals of the clips 200. A selected segment of each of the necklaces 502 and 504 is held between the gripping surfaces of the gripping members of each of the two clips 200. The specific segments selected to be held in the clip 200 dictate the lengths 506 and 508 of the necklaces 502 and 504 that appear on the front of the wearer, as well as the lengths 510 and 512 of the necklaces 502 and 504 that appear on the back of the wearer. Thus, a desired layered arrangement of the necklaces 502 and 504 is achievable, regards of the necklaces' relative lengths.

It should be appreciated that the clips 200 and their structural features can be adjusted in size to accommodate more necklaces, thicker necklaces, etc. In addition, alternative jewelry assemblies can include three or more clips.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A jewelry clip, the jewelry clip having an open configuration and a closed configuration and comprising:

first and second shell pieces, each of the first and second shell pieces having an outer surface and an inner surface, the outer surfaces and inner surfaces together substantially defining a tube, and the inner surfaces of each of the shell pieces each defining a cavity, the cavities together defining a substantially cylindrical interior volume of the clip when the clip is in the closed configuration;

a hinge pivotally coupling the first shell piece and the second shell piece for moving the clip between the open configuration and the closed configuration, the hinge protruding towards the substantially cylindrical interior volume of the clip when the clip is in the closed configuration;

a first gripping member, the first gripping member being resiliently compressible, affixed to the inner surface of the first shell piece, and at least partially filling the cavity of the first shell piece, the first gripping member further defining a first gripping surface; and a second gripping member, the second gripping member being resiliently compressible, affixed to the inner surface of the second shell piece, and at least partially filling the cavity of the second shell piece, the second gripping member further defining a second gripping surface;

wherein the first and the second gripping surfaces face each other when the clip is in the closed configuration; and wherein the jewelry clip further comprises a terminal defining a hole, the terminal being exterior to the cavities and extending from one of the first shell piece or the second shell piece.

2. The jewelry clip of claim 1, wherein the first and second gripping surfaces abut each other when the clip is in the closed configuration.

3. The jewelry clip of claim 1, wherein each of the first and second gripping surfaces includes at least a portion that is substantially planar.

4. The jewelry clip of claim 1, wherein each of the shell pieces is metallic, and wherein each of the gripping members is non-metallic.

5. The jewelry clip of claim 1, wherein the first gripping member substantially fills the cavity of the first shell piece, and wherein the second gripping member substantially fills the cavity of the second shell piece.

6. The jewelry clip of claim 1, wherein at least one of the gripping surfaces is provided with one or more gripping features.

7. The jewelry clip of claim 1, further comprising a terminal base that supports the terminal.

8. The jewelry clip of claim 7, wherein the terminal is a ring.

9. The jewelry clip of claim 8, wherein the terminal base is a crossbar extending from the hinge to the inner surface of one of the shell pieces at an end face of the clip.

10. The jewelry clip of claim 9, further comprising a chain coupled to the terminal.

11. The jewelry clip of claim 10, wherein the gripping members cooperate to hold in place a segment of the chain when the clip is in the closed configuration.

12. The jewelry clip of claim 11, wherein the clip is defined by a longitudinal length, and wherein the segment of the chain has a length that is substantially equal to the longitudinal length of the clip.

13. The jewelry clip of claim 1, further comprising a chain coupled to the terminal.

14. A jewelry assembly comprising:

a jewelry clip having an open configuration and a closed configuration and comprising:

first and second shell pieces, each of the first and second shell pieces having an outer surface and an inner surface, the inner surface of the first shell piece defining a cavity, the cavity at least partially defining an interior volume of the clip when the clip is in the closed configuration;

a hinge pivotally coupling the first shell piece and the second shell piece for moving the clip between the open configuration and the closed configuration, the hinge protruding towards the interior volume of the clip when the clip is in the closed configuration;

a gripping member, the gripping member being affixed to the inner surface of the first shell piece and at least partially filling the cavity of the first shell piece;

the clip further comprising a terminal defining a hole, the terminal being exterior to the cavity and extending from an outer surface of one of the first shell piece or the second shell piece.

15. The jewelry assembly of claim 14, further comprising a chain, the chain being coupled to the terminal.

16. The jewelry assembly of claim 15, wherein the terminal is a ring, and wherein the clip further comprises a terminal base that supports the terminal.

17. The jewelry assembly of claim 16, wherein the terminal base is a crossbar extending from the hinge to the inner surface of the first shell piece.

18. A jewelry assembly comprising:

a jewelry clip, the jewelry clip having an open configuration and a closed configuration and comprising:

first and second shell pieces, each of the first and second shell pieces having an outer surface and an inner surface, the outer surfaces and inner surfaces together substantially defining a tube, and the inner surfaces of each of the shell pieces each defining a cavity, the cavities together defining a substantially cylindrical interior volume of the clip when the clip is in the closed configuration;

a hinge pivotally coupling the first shell piece and the second shell piece for moving the clip between the open configuration and the closed configuration, the hinge being disposed substantially within the interior volume of the clip when the clip is in the closed configuration;

a first gripping member, the first gripping member being resiliently compressible, affixed to the inner surface of the first shell piece, and at least partially filling the cavity of the first shell piece, the first gripping member further defining a first gripping surface;

a second gripping member, the second gripping member being resiliently compressible, affixed to the inner surface of the second shell piece, and at least partially filling the cavity of the second shell piece, the second gripping member further defining a second gripping surface;

a terminal defining a hole, the terminal being exterior to the cavities and extending from one of the first shell piece or the second shell piece;

a crossbar disposed at an end face of the clip, the crossbar extending from the hinge to the inner surface of one of the shell pieces and supporting the terminal; and a first locking element on the first shell piece and a second locking element on the second shell piece, the first and second locking elements cooperating with each other when the clip is in the closed configuration; and a chain, the chain being coupled to the terminal;

wherein the first and second gripping surfaces face each other when the clip is in the closed configuration; and wherein the gripping members cooperate to hold in place a segment of the chain when the clip is in the closed configuration.

* * * * *